United States Patent [19]

Palmer, Jr.

[11] 4,087,870

[45] May 9, 1978

[54] FLOATING POOL ASSEMBLY

[76] Inventor: John M. Palmer, Jr., 1420 Julie Lagoon, Lutz, Fla. 33549

[21] Appl. No.: 710,149

[22] Filed: Jul. 30, 1976

[51] Int. Cl.[2] ..... A47K 3/00; E04H 3/16; E04H 3/18

[52] U.S. Cl. ..... 4/171

[58] Field of Search ..... 4/171, 172.19, 172, 4/1

[56] References Cited

U.S. PATENT DOCUMENTS

| | | | |
|---|---|---|---|
| 1,925,175 | 9/1933 | Day | 4/171 |
| 2,016,456 | 10/1935 | Russell | 4/171 |
| 2,464,358 | 3/1949 | Stehr | 4/171 |
| 3,026,538 | 3/1962 | Boyd et al. | 4/171 |
| 3,078,472 | 2/1963 | Salisbury | 4/171 |
| 3,099,018 | 7/1963 | O'Connell | 4/171 |
| 3,602,925 | 9/1971 | Thompson | 4/171 |

*Primary Examiner*—Henry K. Artis
*Attorney, Agent, or Firm*—John Orman

[57] ABSTRACT

A pool assembly designed to be supported in a natural body of water such as a lake, river, canal, etc., and including a flexible, waterproof liner structure secured about its peripheral edge to a floatation device in the form of a buoyant rim portion disposed in supporting relation to the liner and maintained in floating relation to the surface of the body of water. A floating deck comprising, in part, a hollow portion for storage of the liner when not in use and a filtering assembly, is removably attached to the rim portion by a correspondingly configured channel structure formed in the housing of the deck, wherein the deck itself is buoyant and is disposed in interconnecting relation between the liner and the shore or equivalent permanent installation leading to the liner.

13 Claims, 11 Drawing Figures

FIG. 1
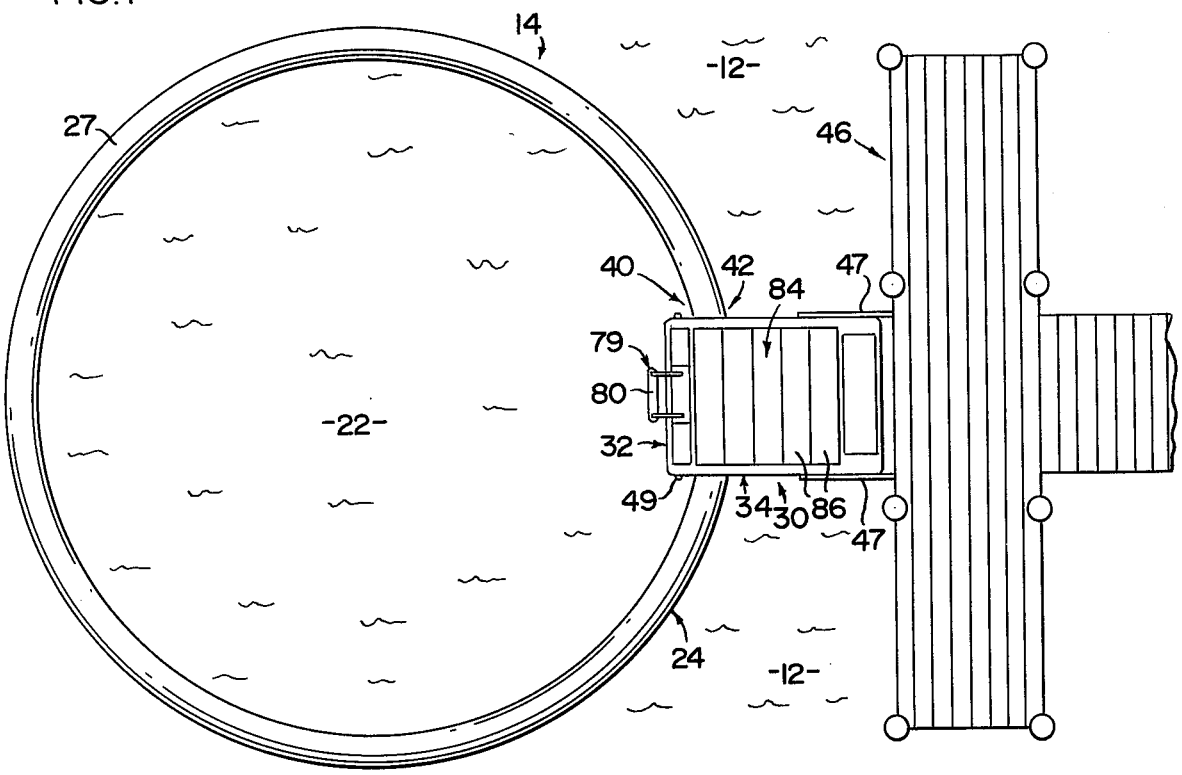
FIG. 2
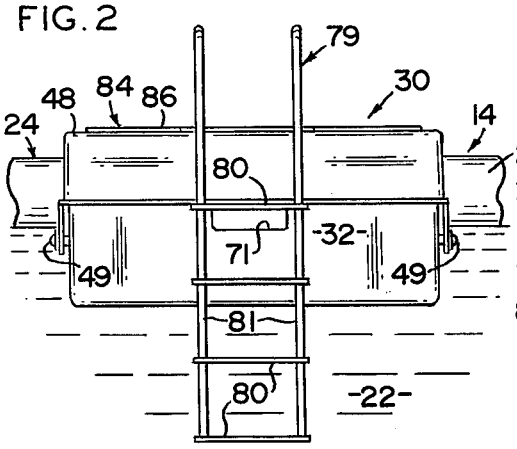
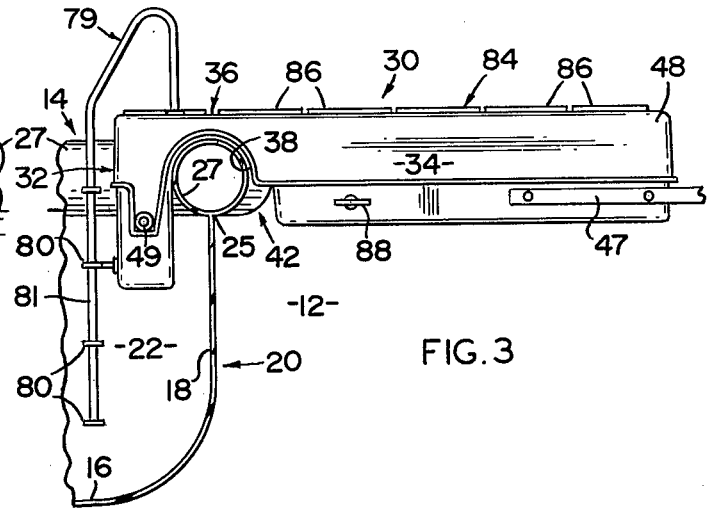
FIG. 3
FIG. 4
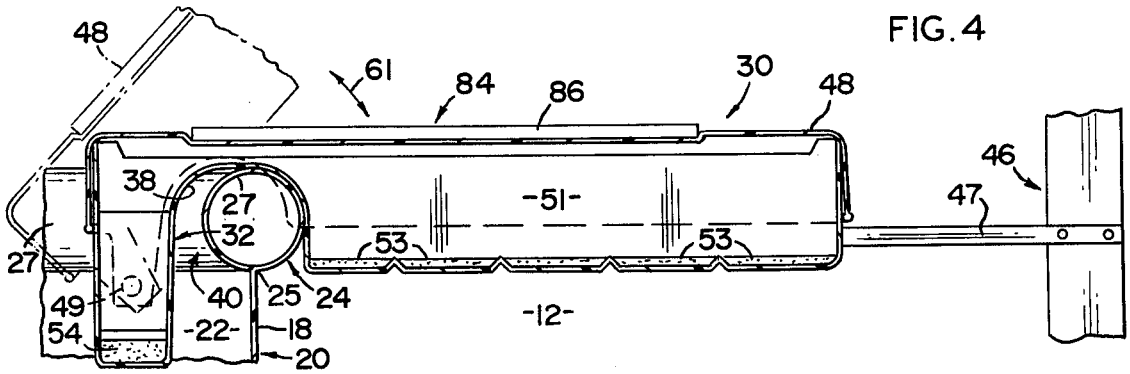

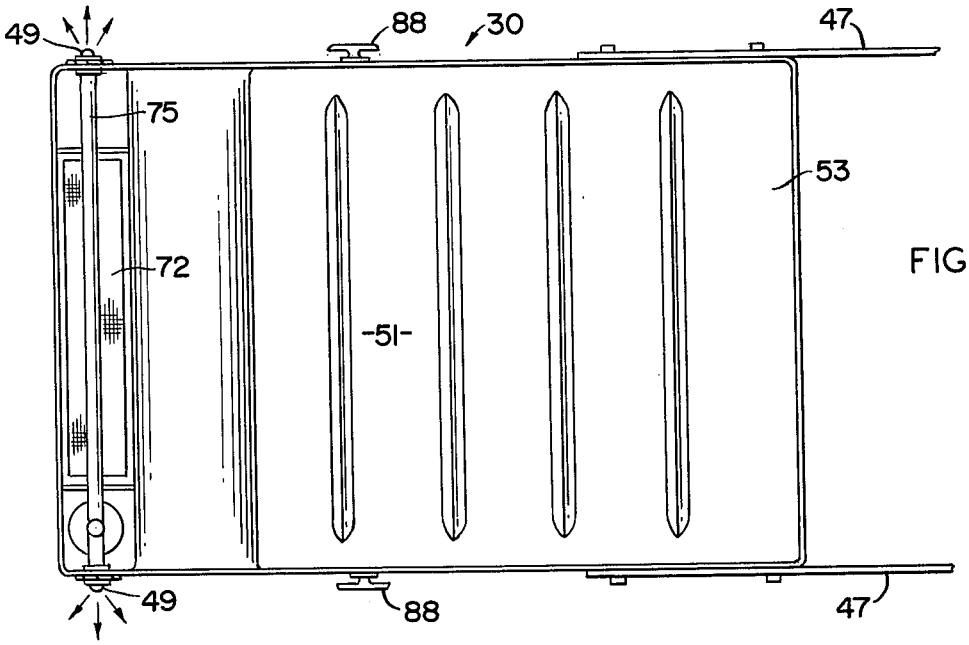
FIG.5
FIG.6
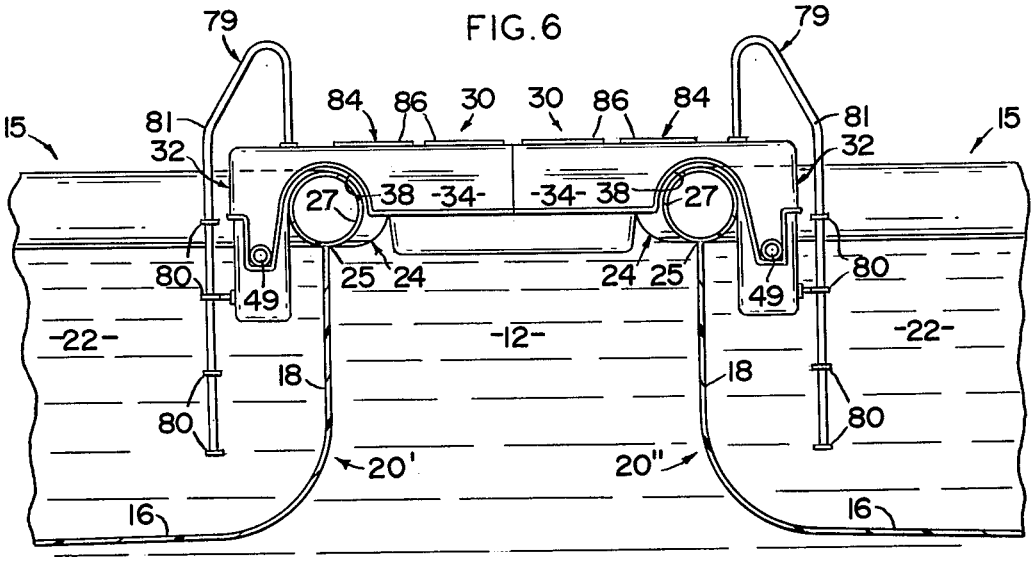
FIG.7
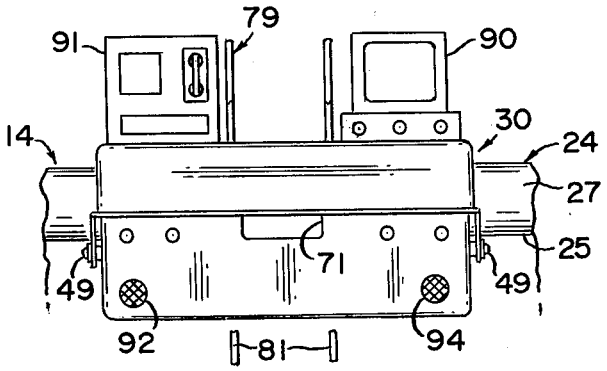

FIG. 8
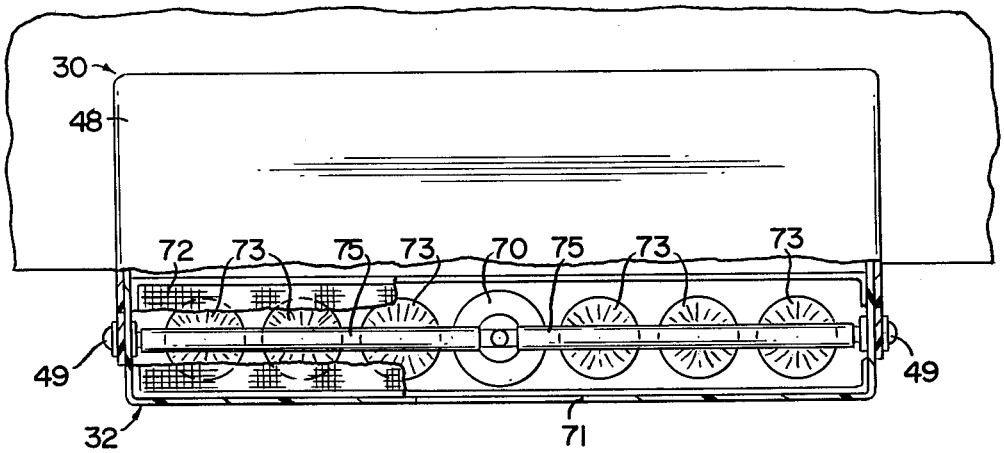
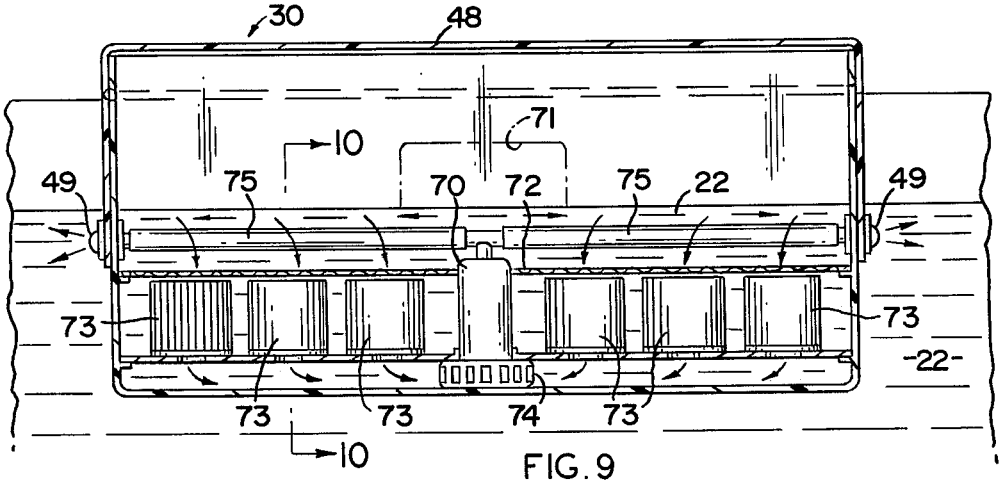
FIG. 9
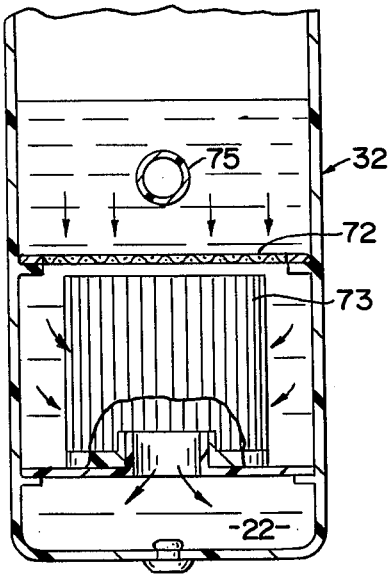
FIG. 10
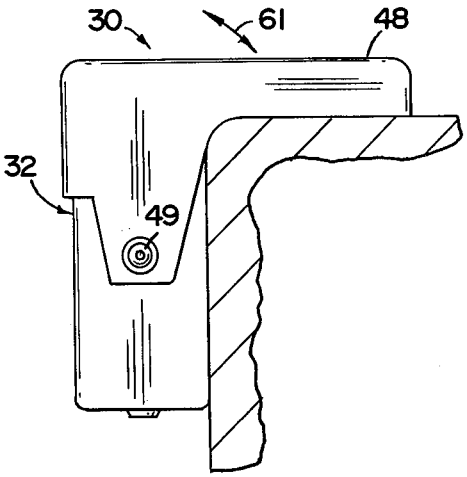
FIG. 11

FLOATING POOL ASSEMBLY

BACKGROUND OF THE INVENTION

1. Field of the Invention

This invention relates to a pool assembly designed and structured to be supportingly positioned in a body of water and be substantially portable by means of the collapsible nature of the liner or liquid container and its interconnection to a floating dock which serves as access to the interior of the liner and the water or liquid maintained therein in segregated relation to the surrounding supportive body of water.

2. Description of the Prior Art

Swimming pools primarily used for recreational and in certain instances health purposes have, of course, been known and used by mankind for literally hundreds of years. With the advent of modern society and its accompanying affluence, the popularity of swimming pools and like structures have increased significantly during the 20th century. Primarily such pool structures have taken the form of permanent installation adapted for both public and residential use. Particularly in the area of residential application swimming pools are relatively common in environments which allow their use for primarily recreational purposes over many months of the year.

However, while such permanent pool structure installations have become more popular in recent years, their cost of installation has increased to the point where their availability to the average person is becoming increasingly questioned.

In an effort to overcome such high costs, the swimming pool industry has developed "portable" type structures which are capable of being installed on land but which have obvious drawbacks and limitations relating to their durability and operative life. Such limitations have obviously affected their desirability which in turn has resulted in searching by the consuming public for a swimming pool structure which is functionally more desirable than static, "on land" portable swimming pool structures but yet less expensive than permanent installations.

Accordingly, attempts have been made to fill this void by members of the commercial swimming pool industry. Such attempts have resulted in the basic conception of "floating pools" which have distinctive qualities from the "on land" portable pool assemblies. More specifically, such "floating pools" are specifically designed and maintained to be supported within a "natural or man-made body of water" such as a lake, river, stream, reservoir, etc.

Such "floating pool assemblies" are represented in the prior art by the patent to Salisbury, U.S. Pat. No. 3,078,472.

While such a prior art structure is certainly operable and desirable for certain specific applications, the structural concept of the floating pool assembly has become desirable to the point of innovating new structural designs and concepts which are now more versatile. These new and more desirable designs lend themself to a wide variety of applications generally not serviceable by the various prior art pool assemblies which are now commercially available. Accordingly, there is seen a need in the swimming pool industry for a portable pool assembly which is specifically designed for operation within a larger, either natural or man-made body of water such as a lake, reservoir, river, etc. Such structure should be capable of being relatively portable so as to facilitate removal to various locations but yet have the structural integrity to provide the operational characteristics generally similar to a permanent pool installations. Such design characteristics should include adequate size, depth and support to provide the capabilities of handling a plurality of people. Such plurality of people will be capable of providing support on the deck and within the liquid maintained in segregated relation to the supportive body of water in which the floating pool assembly is maintained.

In addition, the floating pool structure of the present invention should be capable of being adapted to a "semi-permanent" installation wherein it is intended to maintain the subject assembly in one location for a relatively long period of time. Concurrently such pool assembly should be capable of being transported relatively easily to various locations including extremely temporary sites such as when camping or when traveling relatively long distances.

SUMMARY OF THE INVENTION

This invention relates to a floating pool assembly of the type primarily designed to be supported and maintained in a larger body of water. Obviously, it is intended to be within the scope of the present invention that the term "body of water" includes natural water bodies such as lakes, rivers, etc., or man-made bodies of water such as reservoirs, lagoons, etc.

The pool assembly of the present invention comprises a liner means made from a flexible sheet like element of liquid impermeable material. In addition, the liner means comprises a floatation means in the form of a buoyant rim portion.

In one embodiment of the present invention the rim portion comprises an inflatable tubular element essentially defining the peripheral boundaries of the liner means and being secured to the side walls of the liner means around the peripheral edge of the liner means. Due to the buoyant relationship of the rim portion of the liner means to the remainder thereof, it is maintained essentially or at least partially on the surface of the body of water in supporting relationship to the remainder of the liner means. In addition, due to the impermeable nature of the sheet like material comprising the liner means liquid or water may be contained on the interior of the liner means in segregated relation to the body of water in which it is supported.

Yet another embodiment of the present invention comprises the rim portion being structured and configured to define the peripheral boundaries of the liner means but being formed from a buoyant, substantially rigid material. The term "rigid material," within the scope of the present invention is intended to include such buoyant material which is not necessarily specifically hardened. More specifically, buoyant type resins, plastics, or foam like material is intended to be included within the term "substantially rigid" and still be maintained within the scope of the present invention.

Another structural feature of the present invention comprises a deck assembly substantially disposed in interconnecting relation between the liner means and the shore. Again, the term shore is meant to include other relatively permanent installations which is interconnected to the subject pool assembly including land or other land substitute platforms such as a dock, marinecraft, etc. The subject deck assembly includes a housing having at least a first and second portion wherein the first portion is disposed on the interior of the liner relative to the buoyant rim portion and further disposed in substantially submerged relation to the water maintained therein. This first housing portion includes a filter assembly comprising a pump substantially maintained in submerged relation to the water within the liner means. The filter assembly further includes one or more filter cartridge elements disposed in fluid communication between incoming water from the interior of the liner, through an inlet formed in the first housing portion to the pump. An interconnecting conduit is connected from the pump to a liquid output including nozzles wherein the pump serves to draw liquid through the inlet, from the interior of the container through the filtering cartridges or elements and, after filtering, forces such water back to the interior of the liner means. This assembly may therefore provide an independent filtering operation of the water within the liner means so as to maintain such water acceptable for swimming, bathing or the like.

The second portion of the deck housing is at least in part hollow so as to provide capacity for maintaining the liner means in a stored position when the pool assembly is not in actual use. Such is highly desirable when the pool assembly is being transported between various locations or maintained in a stored condition. A lid facility is further movably mounted on the housing and is pivotally attached thereto so as to provide access to either the first or second housing portion.

An important structural feature of the housing comprises a connecting means comprising the housing being configured to define a channel element correspondingly configured or shaped relative to the rim portion or floatation means of the liner means. By virtue of this design the connecting means is disposed in overlapping or at least partially surrounding relation to the rim portion and thereby is at least in part movably supported thereon. This channel means allows a free, movable yet secure, attached relation between the deck assembly and the liner means.

Supplementary float elements may be placed in the first and/or second housing portion so as to maintain the housing in buoyant, supported relation essentially on the surface of the body of water in which the subject pool assembly is being maintained. Alternately, only the second housing portion has supplementary float elements formed thereon or alternately is made from an inherently buoyant material. In this embodiment the first housing portion is maintained in its desired relative position by virtue of its substantially cantilevered connection to the second housing.

In addition to the above, the dimensional and design characteristics of the housing is such as to provide a support platform thereon which is capable of supporting one or more bodies thereon in either upstanding or reclining position. The full facility of the floating pool assembly is thereby possible for enjoyment in the conventional manner as when sunbathing, etc.

Other structural features of the present invention comprise the provision of a ladder fixedly attached to the housing of the deck assembly wherein the ladder is disposed in downwardly extending, at least partially submerged relation to the water which is maintained on the interior of the liner means. Obviously, the ladder is provided for access to the water maintained therein in the substantially conventional manner.

This invention accordingly comprises the features of construction, combination of elements and arrangements of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a top view of the floating pool assembly of the present invention interconnected to a dock, shore or like supportive platform.

FIG. 2 is a front view, in partial cutaway, showing the housing of the deck assembly and the attachment of the ladder member thereto.

FIG. 3 is a side view, in partial section, showing the relation of the deck assembly to the liner means of the pool assembly.

FIG. 4 is a sectional view, in partial cutaway, showing the relation of the deck assembly to the liner means.

FIG. 5 is a top, detailed view showing the support platform of the housing of the deck assembly and the relation of certain portions of the filter assembly to the interior of the liner.

FIG. 6 represents one embodiment of the present invention wherein the liner means comprises a plurality of spaced apart, segregated liner elements both of which are supported in an external body of water and interconnected by a deck assembly.

FIG. 7 represents yet another embodiment of the present invention which includes various supplementary facilities being integrally attached or mounted on the deck assembly of the present invention.

FIG. 8 is a top view, in partial cutaway and section, showing details of the filter assembly of the present invention.

FIG. 9 is a sectional view of the embodiment of the filter assembly shown in FIG. 8.

FIG. 10 is a sectional view along the interior end of the filter assembly shown in detail of the fluid flow and filtering cartridge which is defined as part of the filter assembly.

FIG. 11 is a partial sectional view of details of the first housing portion of the deck assembly of the present invention.

Similar reference characters refer to similar parts throughout the several views of the drawings.

DETAILED DESCRIPTION

As shown in FIG. 1, the pool assembly of the present invention is generally indicated as 10 and, as shown, is designed to be supportingly maintained in an exterior body of water 12. The pool assembly further comprises liner means 14 including a base portion 16 and side wall means 18. The base portion and side wall means may be integrally connected to one another and formed from a flexible sheet like element which is essentially liquid impermeable. The configuration of the liner means is such as to form a liquid container generally indicated as 20 configured to maintain water 22 for swimming therein.

The liner means further includes floatation means generally indicated as 24. This floatation means may extend about the peripheral edge 25 of the liner means 14 or side wall thereof 18 in liquid sealing engagement thereto. This interconnection extends in at least one embodiment about the entire peripheral edge 25 so as to define the upper peripheral boundary of the liner means 14. The floatation means, due to its disposition, thereby provides adequate support to the remainder of the liner means due to its maintenance in floating relation to the surface of the body of water 12 as clearly shown in FIGS. 2 and 3.

In one embodiment of the present invention the floatation means 24 is provided in the form of a rim portion which includes an elongated, continuously disposed tube 27 which is inflatable to provide its buoyant relation to the supporting body of water 12 as well as the water 22 maintained within the interior of the liner means. The buoyancy of the rim portion is, of course, due to its inflated relationship.

Yet another embodiment of the present invention comprises the rim portion 27 being made from a substantially ridged or hardened material such as plastic, resin, foam, etc. Such hardened or ridged material is inherently buoyant due to it being formed from a material which has a specific gravity less than water.

Irrespective of the embodiment utilized, the rim portion 27 may form substantially the entire peripheral boundary of the liner means 14 and thereby provide its supporting relation to the remainder of the liner means relative to the body of water 12 and the water 22 maintained within the side wall 18 and base portion 16 of the liner means.

The pool assembly of the present invention further comprises a deck portion generally indicated as 30.

With regard to FIGS. 2, 3 and 4 this deck portion 30 includes a housing comprising a first portion 32 and a second portion 34. These first and second portions 32 and 34 are interconnected approximately as at 36 and are specifically disposed to one another and otherwise define the configuration of the housing so as to define a channel means 38. This channel means is specifically designed and configured to substantially correspond to the rim portion 27. This corresponding configuration between the channel means 38 and the rim portion 27 allows a removable, loose but secure interconnection between the deck portion 30 and the liner means 14. The channel means 38 thereby forms the connecting means whereby the deck portion 30 is disposed in overlapped relation and in at least partially surrounding relation to the rim portion 27 which, in the embodiment described above, defines the floatation means of the present invention.

In the embodiments shown in FIGS. 3 and 4, the first portion 32 of the housing and the second portion 34 of the housing are oppositely disposed relative to the rim portion 27. More specifically, the first portion of the housing 32 is disposed on the "interior" of the liner means wherein this interior disposition is generally indicated as 40. Conversely, the second portion 34 of the deck portion 30 is disposed on the "exterior" of the liner means wherein such exterior disposition is generally indicated as 42. (FIG. 1) In the embodiments shown in FIGS. 1–4, the deck portion 30 is interconnected to the shore 46 which may be in the form of a support platform, marinecraft, etc., and attached thereto by an interconnecting bracket 47.

Other structural features of the dock assembly and/or housing comprise a cover means generally indicated as 48 which is pivotally attached as at pivotal connections 49. By virtue of this pivotal connection the cover means 48 may be rotatably attached to the first housing portion 32 so as to dispose the interior of the housing and both the interiors of the first portion 32 and second portion 34. The pivotal position of the cover means 48 is represented in broken lines in FIG. 4 and is movable between its open and close position as generally indicated by directional arrow 61. It should be noted that the second housing portion 34 may have at least a portion of its interior hollow as at 51 so as to provide storage facilities for the liner means 14 when it is in its closed or nonoperative position. This facilitates the storage, or transport of the entire pool assembly as can be clearly seen.

Further structural features of the present invention may comprise supplementary float elements 53 affixed to the second housing portion 34 so as to maintain it in floating relation to the body of water. In addition, the first housing portion 32 may include a supplementary float element 54 so as to maintain it in the desired, at least partially supported and floating position relative to the water 22 maintained within the liquid container 20. Alternately, the substantially cantilevered disposition and interconnection of the first housing portion 32 relative to the second housing portion 34 will maintain it in its desired position especially due to the supporting relation of the rim portion 27 to the deck portion or housing of the deck portion as best shown in FIGS. 3 and 4.

Again, access to the interior of both the first housing portion 32 and second housing portion 34 may be obtained by the pivotal movement of the cover means 48 about the pivotal elements 49.

Along these lines a filter assembly (FIGS. 8, 9, 10 and 11) may be encased or at least partially housed within the first housing portion 32.

More specifically, the filtering assembly includes a pump 70 disposed in submerged relation relative to the water 22 maintained on the interior of the liner means. This water enters through water inlet 71 formed in the first housing portion 32 (FIG. 2) of the deck portion. More specifically, the inlet 71 comprises a specifically configured aperture which serves as a skimmer and is substantially level to the surface of the water 22 within the liner means. A filtering screen 72 is disposed upstream of a plurality of filter cartridges 73 through which water passes as it flows from the inlet 71 to the pump intake 74. The action of the pump 70 forces the filtered water 22 up through interconnecting conduit 75 through water outlets 49. As set forth above, the water outlets 49 also serve as a pivotal connection for the cover means 48 about which the cover means pivots to provide access to the interior of the first housing portion 32 and second housing portion 34. While the embodiment shown in FIGS. 8, 9 and 10 show an independent filtering system as described above, it should be noted that the first housing portion 32 can be adapted to specifically have connected thereto a substantially conventional filtering system other than that described in the embodiment of FIGS. 8, 9 and 10.

Other structural features of the present invention comprise the provision of a ladder means 79 mounted on the deck portion and more specifically connected to the first housing portion 32 as shown primarily in FIGS. 2 and 3. This ladder means 79 provides access to the interior of the liquid container 20 and the water 22 therein in a conventional manner. Specifically, the ladder assembly comprises a plurality of steps 80 disposed in spaced relation to one another and interconnected between substantially parallel disposed legs 81.

With regard to FIG. 6, another structural feature of the present invention comprises the provision of a support platform generally indicated as 84 having a tread surface as at 86 to prevent slippage when one stands or travels over the support surface 84. Securing cleats 88 are provided as shown in FIG. 5 to serve as securing connections of the deck portion to any type of support platform.

Yet another embodiment of the present invention is disclosed in FIGS. 6 and 7 and comprises the deck portion 30 having a plurality of channel elements 38 for the connecting means so that the liner means can be defined by a plurality of liner elements 15. In this embodiment the liner elements 15 are disposed in spaced apart, segregated relation with one another wherein two separate liquid containers 20' and 20'' are provided. In this embodiment the dimension and configuration of the second housing portion 34 is such as to interconnect the two liner elements 15 with one another such that the first housing portion 32 is disposed in submerged relation to the separate liquid containers 20' and 20'' of the individual and separated liner elements.

With regard to FIG. 7 a plurality of auxiliary facilities such as television set 90, and telephone and general communication components 91 are mounted on the deck portion. In addition, lights 92 and/or sound systems 94 may be built into the deck portion in various relation as shown in FIG. 7.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A pool assembly of the type primarily designed to be floatingly supported in a body of water, said pool assembly comprising: liner means dimensioned and configured to define a liquid container disposed in substantially segregated relation from the body of water, said liner means comprising a base portion and side wall means both formed from a flexible sheet element, said liner means further including floatation means secured to said side wall means along the length of said side wall means, said floatation means formed from a buoyant material, said floatation means disposed to substantially define at least a portion of the peripheral boundary of said liner means and positioned in supporting relation to the remainder of said liner means at least in part on the surface of the body of water; deck means comprising a housing formed in part from buoyant material and supportingly disposed on the surface of the body of water, connecting means formed in said housing and configured to substantially correspond to said floatation means and be removably secured thereto; said housing comprising a first housing portion substantially disposed on the interior of said liner means relative to said floatation means, and a second housing portion substantially disposed on the exterior of said liner means relative to said floatation means, said first and second housing portions operatively disposed relative to one another on opposite sides of said floatation means, whereby water may be maintained within said liquid container for swimming and in segregated relation to the body of water in which said pool assembly is supported.

2. A pool assembly as in claim 1 wherein said connecting means comprises channel means formed in said housing and configured substantially corresponding to said floatation means, said floatation means comprising a buoyant rim portion substantially defining the periphery of said liner means, said channel means disposed in overlapping, at least partially surrounding relation to said rim portion and in supported relation to said rim portion.

3. A pool assembly as in claim 2 wherein said rim portion comprises an inflated tubular element maintained in floating relation to the surface of the body of water and in supported relation to the remainder of said liner means.

4. A pool assembly as in claim 2 wherein said rim portion comprises a substantially rigid, buoyant structural assembly disposed in a continuous length and thereby defines the supporting periphery of said liner means.

5. A pool assembly as in claim 1 wherein both said first and second housing portions comprise supplementary float means attached thereto, whereby said housing is maintained at least in part on the surface of the body of water in which said pool assembly is supported.

6. A pool assembly as in claim 1 wherein said first housing portion is disposed in at least partially submerged relation to the water maintained in the interior of said liner means; filter means mounted within said first housing portion in submerged filtering relation to water within said liner means.

7. A pool assembly as in claim 6 wherein said filter means comprises a pump element disposed in submerged relation to water within said liquid container, a plurality of filter elements disposed in upstream fluid communication to said pump and said first housing portion, output means interconnected to said pump means by interconnecting conduit, disposed in water delivering communication to the exterior of said first housing portion and the interior of said line means, inlet means integrally formed in said first housing portion and in water receiving relation to the water within said liner means.

8. A pool assembly as in claim 1 wherein said first housing portion comprises at least a partially hollow interior, cover means pivotally attached to said housing and disposed in at least covering relation to said first housing portion, whereby access to said first housing portion is obtainable.

9. A pool assembly as in claim 1 wherein said first and second housing portions are disposed in interconnecting relation to one another and configured to collectably define at least a portion of said channel means, said channel means movably mounted on said floatation means and serving to secure said dock assembly to said floatation means.

10. A pool assembly as in claim 1 wherein said second housing portion comprises a support platform being specifically configured and dimensioned to support a human body thereon.

11. A pool assembly as in claim 1 wherein said liner means comprises at least two liner assemblies interconnected to one another by said deck means, said connecting means formed in said housing of said deck means and comprising at least two channel elements disposed in spaced relation to one another and removably mounted on the floatation means of each of said liner elements.

12. A pool assembly as in claim 1 wherein said first housing portion is connected in substantially cantilevered relation to said second housing portion and disposed substantially adjacent said channel means and extending into the interior of said liner means.

13. A pool assembly of the type primarily designed to be floatingly supported in a body of water, said pool assembly comprising: liner means dimensioned and configured to define a liquid container disposed in substantially segregated relation from the body of water, said liner means comprising a base portion and side wall means, said side wall means defining a peripheral edge oppositely disposed along said side wall means from said base portion serving to define the open end of said liner means, floatation means secured to said side wall means along the length of said peripheral edge, said peripheral edge secured to said floatation means along the undersurface thereof so as to define a continuous junction, said continuous junction disposed below the surface of the water maintained within said liner means and the surface of the body of water in which said pool assembly is supported; said floatation means formed from a buoyant material and disposed to substantially define at least a portion of the peripheral boundary of said liner means and positioned in supporting relation to the remainder of said liner means at least in part on the surface of the body of water, whereby water may be maintained within said liquid container for swimming and in segregated relation to the body of water in which said pool assembly is supported.

* * * * *